United States Patent [19]

Armstrong

[11] 4,151,881

[45] May 1, 1979

[54] APPARATUS FOR COMPLETING A WELL

[76] Inventor: Ernest E. Armstrong, 3521 Seaboard, Midland, Tex. 79701

[21] Appl. No.: 835,681

[22] Filed: Sep. 22, 1977

[51] Int. Cl.[2] ..... E21B 33/12

[52] U.S. Cl. ..... 166/318; 166/315

[58] Field of Search ..... 166/317, 318, 315, 179, 166/192

[56] References Cited

U.S. PATENT DOCUMENTS

| | | | |
|---|---|---|---|
| 2,545,504 | 3/1951 | Villafane | 166/317 |
| 2,565,731 | 8/1951 | Johnston | 166/317 |
| 2,638,167 | 5/1953 | Jones | 166/317 |
| 2,676,661 | 4/1954 | Crooke, Jr. | 166/318 |
| 2,903,074 | 9/1959 | Layton et al. | 166/317 |
| 2,922,479 | 1/1960 | Kinley | 166/317 |
| 3,003,565 | 10/1961 | Courtney | 166/331 |
| 3,029,875 | 4/1962 | Moller | 166/317 |
| 3,095,040 | 6/1963 | Bramlett | 166/317 |
| 3,931,855 | 1/1976 | Vann et al. | 166/128 |

*Primary Examiner*—Stephen J. Novosad
*Attorney, Agent, or Firm*—Marcus L. Bates

[57] ABSTRACT

Apparatus for completing a wellbore which has a hydrocarbon containing formation located downhole therein and wherein the well is perforated and filled with mud. A special plug, made in accordance with the invention, is placed in the end of a tubing string, and the string run dry into the borehole with the lower end of the string terminating in proximity of the perforations. The annulus is packed off and a weight dropped down through the string. The weight impacts against a special valve contained within the plug, thereby upsetting a valve element. This action communicates the interior of the string with the borehole, whereupon the lower borehole or bottomhole pressure is equalized across the plug, and the plug and weight fall from the end of the string and to the bottom of the borehole. The string is opened to ambient which allows flow to occur in order to clean out the well, and thereafter the string is connected to a gathering system.

8 Claims, 6 Drawing Figures

APPARATUS FOR COMPLETING A WELL

BACKGROUND OF THE INVENTION

Out in the vast oil fields of West Texas there are many wellbores formed which extend thousands of feet down into the ground. These wellbores are filled with a sufficient head of mud so that the pressure effected by the gaseous hydrocarbons are thereby contained within the pay zone. A casing is cemented into place thereby sealing each of the overlying formations from one another and preventing contamination of various different zones of various different substances with one another. Thereafter a casing gun is run downhole and one or more hydrocarbon containing formations communicated with the wellbore by means of perforations which are formed through the casing, cement, and back up into the pay zone. It is customary to next run a tubing string downhole into proximity of the perforations, and then the annulus above the end of the tubing string is packed off. The interior of the tubing must next be swabbed to remove the mud therefrom, thereby reducing the hydrostatic head effected by the mud upon the pay zone so that when the hydrostatic head is reduced to a value which is less than the bottom hole pressure exerted by the formation, production of hydrocarbons commences from the pay zone, through the perforations, into the lower borehole, into the bottom of the tubing string, and up through the string to the surface of the earth where the production is tied into a suitable gathering system.

It is expensive to move a swabbing crew along with a workover rig onto the well site, and for this reason it would be advantageous to have made available both method and apparatus by which the tubing string could be run dry into the perforated borehole so that after the string was properly positioned and the packer set, the tubing could be open to flow, whereupon the necessity of the expensive swabbing crew and the costly workover rig would be eliminated.

Some prior art solutions to the above problems and desires are known, for example, Bramlett U.S. Pat. No. 3,095,040 uses a go-devil for rupturing a break off-plug. Moller U.S. Pat. No. 3,029,875 drops a weighted object to dislodge a plug from a pipe. Layton U.S. Pat. No. 2,903,074; Kinley U.S. Pat. No. 2,922,479; and Courtney U.S. Pat. No. 3,003,565 each disclose a device for establishing communication between a tubing string and the casing by dropping a weighted object. U.S. Pat. No. 3,931,855 shows a plug in combination with other well completion apparatus and teaches a method of completing a well. The present invention represents an advancement over the above related art.

SUMMARY OF THE INVENTION

This invention relates to apparatus for completing a wellbore which has been cased, comprising; perforating the casing adjacent to the pay zone and running a dry tubing downhole into proximity of the perforations. The annulus between the casing and the tubing is packed off and the string is closed at the surface of the ground.

The dry tubing is accomplished by the provision of a special plug having a valve element formed therein which is opened upon impact of a weighted object thereagainst. Accordingly, a weighted bar is dropped from the surface of the ground, down through the interior of the tubing string, and falls against the plug of the present invention, thereby moving the valve element thereof from a closed into the open position, whereupon the pressure equalizes across the plug. The plug and weighted object fall to the bottom of the borehole, the tubing is opened to flow from the surface of the earth, and the well is cleaned up and put on production with flow occurring from the pay zone, through the perforations, up into and through the tubing string, and to the surface of the earth.

The plug of the present invention is tapered and sealingly engages the lower marginal interior of the tubing string. The valve element is an elongated member removably received within an axial bore formed through the plug. A marginal end of the valve element extends above the plug and into the interior of the tubing string so that when the weighted object impacts against the plug, the valve element is moved to the open position and the pressure equalized thereacross.

Accordingly, a primary object of the present invention is the provision of apparatus for completing a hydrocarbon containing wellbore.

A still further object of this invention is to provide a well completion apparatus which eliminates the necessity of swabbing the tubing string.

Another and still further object of this invention is to provide a well completion apparatus by which a dry tubing string is run into a perforated borehole, a packer set, and the well put on production without the necessity of swabbing the tubing string.

The above objects are attained in accordance with the present invention by the provision of a combination of elements which are fabricated in a manner substantially as described in the above abstract and summary.

These and various other objects and advantages of the invention will become readily apparent to those skilled in the art upon reading the following detailed description and claims and by referring to the accompanying drawings.

DETAILED DESCRIPTION OF THE PREFERRED EMBODIMENT

Figure 1:
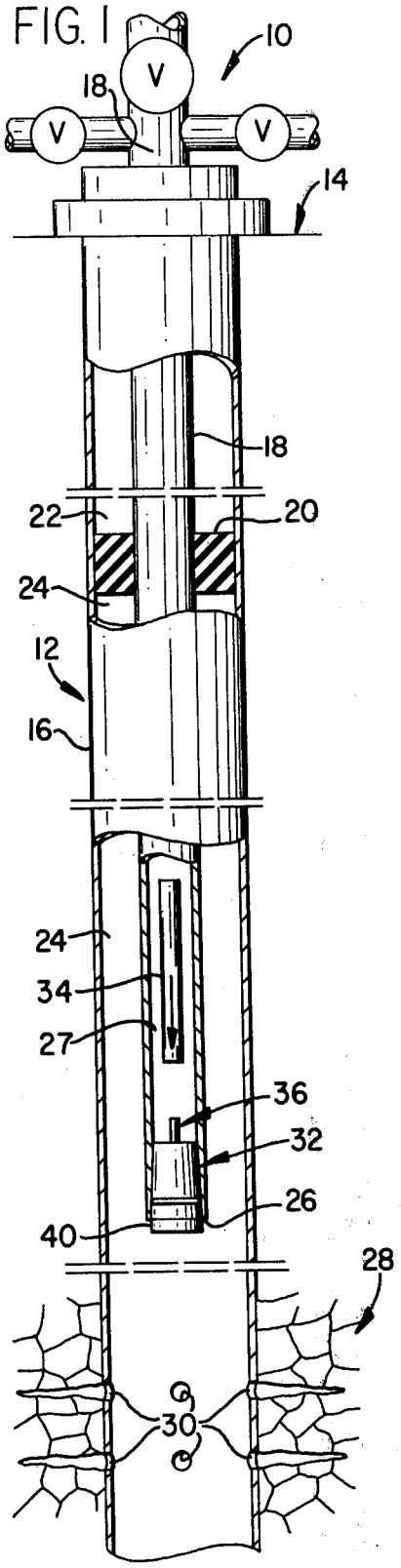
FIG. 1 is a diagrammatical representation of a cross section of the earth disclosing a borehole formed therein with apparatus made in accordance with the present invention being included therein, with some parts thereof being broken away therefrom and some of the remaining parts being shown in cross-section.

In FIG. 1 there is disclosed an oil well 10 which includes a wellbore 12 formed down through the surface 14 of the ground. A casing 16 is cemented within the wellbore while a tubing string 18 is concentrically aligned in axial relationship therewithin. Packer 20 separates the upper annulus 22 from the lower annulus 24.

The lower end 26 of the tubing string terminates in proximity of a hydrocarbon containing formation 28. Perforations 30 are formed through the casing and back up into the formation as may be obtained by employment of a jet perforating gun known to those skilled in the art.

A plug 32, made in accordance with the present invention, is received within the lower marginal end of the tubing string so that the string remains dry, that is, the interior of the string is isolated from the interior of the borehole. A weighted object in the form of a go-devil 34 preferably is a four foot piece of iron bar having a diameter slightly less than the inside diameter of the tubing string.

The plug 32 includes a valve element 36 which is moved to the open position upon impact by the weighted object, thereby equalizing the pressure across the plug, as will be pointed out in greater detail later on in this disclosure.

Figure 2:
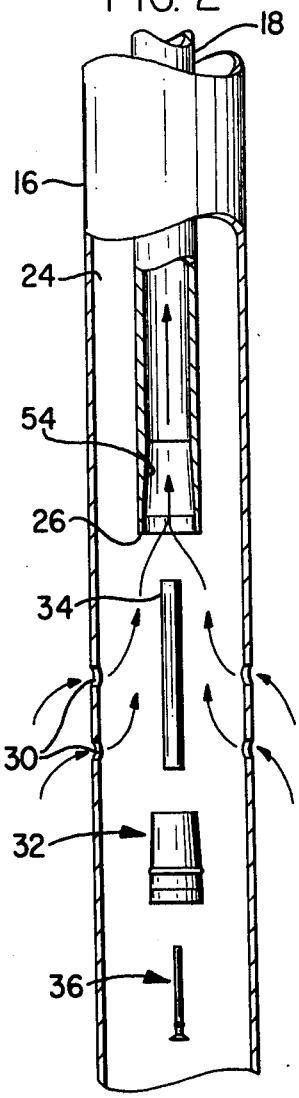
FIG. 2 is a fragmentary, part cross-sectional representation of part of the apparatus disclosed in FIG. 1 shown in an alternate configuration.

In FIG. 2 it will be noted that the go-devil has previously impacted against the plug, thereby moving the valve element to the open position, whereupon the pressure has been equalized across the plug causing the valve element 36 to freely fall from the plug 32, the plug 32 to freely fall from the end of the tubing string, and for the go-devil to fall from the tubing string whereupon the go-devil, plug, and valve element are free to continue falling to the bottom of the borehole.

In FIGS. 3–6 there is disclosed a specific form of the plug of the present invention. The plug includes an upper face 38, a constant diameter exterior 40 which commences to inwardly taper in an upward direction at 42 thereby forming a conical face; and accordingly, the upper marginal end of the plug is a frustrum of a cone. Lower face 44 is opposed to the upper face while an axial bore 46 extends through the plug so that flow can occur therethrough when the valve element 36 is moved to the open position as seen illustrated in FIG. 4.

The axial bore 46 is substantially larger than the outside diameter of the valve element 36, thereby leaving a small annular area between the valve element and the axial bore. The lower marginal end of the axial bore outwardly diverges at 48.

A seal means in the form of a circumferentially extending groove 50 receives o-ring 52 therewithin, and is formed circumferentially about the outer peripheral surface area of the conical face of the plug. The lower marginal end of the interior of the tubing preferably is made complementary at 54 respective to the outer conical face of the plug.

Lower face 56 of the go-devil can be abuttingly received against the upper face 58 of the valve element 36 and against the upper face 38 of the plug. The valve element includes an enlarged lower end 60 made complimentary respective to the countersunk or conical entrance 48. A seal means is formed between the valve element and the axial bore which preferably is an o-ring groove 62 within which there is received an o-ring 64 so that when the plug and valve element is in the configuration of FIG. 3, the flow of fluid is procluded through the annular flow passageway at 46, and when the valve element is moved into the configuration seen in FIG. 4, flow can occur through the illustrated annular flow passageway seen at 46. less

OPERATION

In practicing the method of the present invention those skilled in the art will understand that the perforations 30 may be formed in any number of different manners, including the use of either a casing or through tubing, wire-line actuated jet perforating gun as well as sometimes including termination of the casing and cement at a location slightly above the pay zone or strata 28. Since this expedient communicates the pay zone 28 with the lower end of the tubing, it is deemed to fall within the comprehension of the term "communicating the hydrocarbon producing formation with the interior of the casing". Moreover, the end 26 of the tubing string can be located either below or above the pay zone 28 but preferably is located in the illustrated manner of FIG. 1 so that errosion thereof is significantly reduced. The packer 20 can be located in close proximity of the end of the tubing string so long as it is placed above the pay zone 28 and at an elevation where the resulting hydrostatic head therebelow is loss than the shut-in bottom hole pressure, which is one of the primary objects of this invention. Otherwise, it will be impossible to put the well on production without resorting to the necessity of swabbing.

After the borehole has been formed, the casing run into the hole and cemented into position, the hydrocarbon containing formation 28 is communicated with the interior of the borehole, as for example, by the formation of perforations 30 which are obtained by running a casing jet perforating gun downhole and perforating the casing so that the illustrated tunnels are formed back up into the pay zone 28. During this time the borehole is filled with sufficient mud to cause the hydrostatic head to exceed the shut-in bottom hole pressure.

Figure 3:
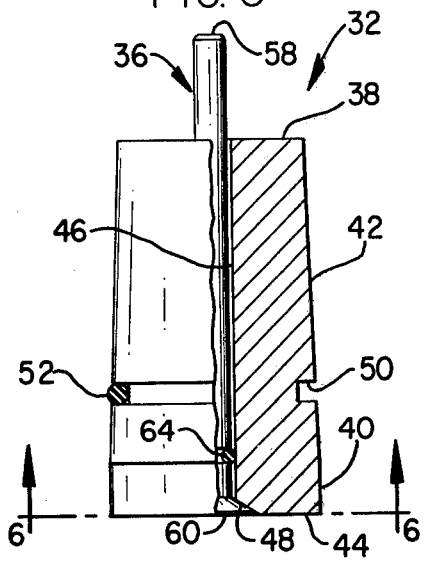
FIG. 3 is an enlarged, part cross-sectional representation of part of the apparatus disclosed in the foregoing figures.
Figure 4:
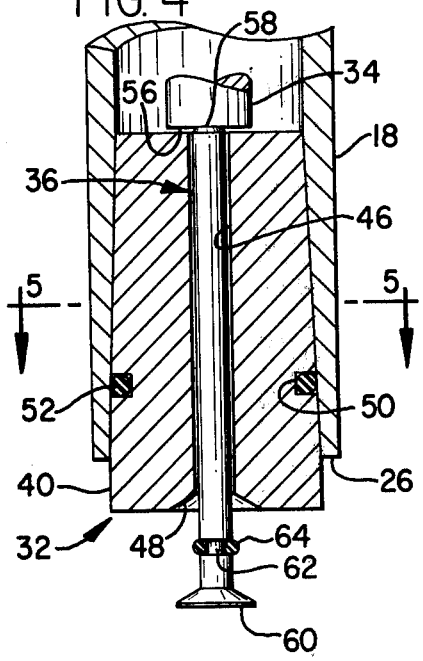
FIG. 4 is a fragmented, enlarged, part cross-sectional representation of part of the apparatus disclosed in some of the foregoing figures.
Figure 5:
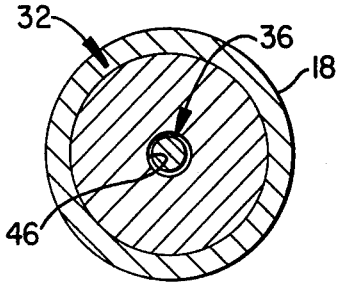
FIG. 5 is a cross-sectional view taken along lines 5—5 of FIG. 4; and, FIG. 6 is a bottom view taken along lines 6—6 of FIG. 3.
Figure 6:
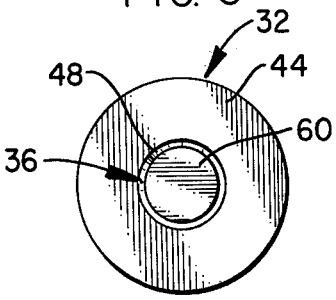

The valve element and plug are next assembled in the manner of FIG. 3 and placed within the end of the tubing string in the manner of FIG. 1, the joints comprising the tubing string are thereby made up and run dry into the borehole, the packer set, the wellhead assembled in the manner of FIG. 1, and all of the valves are closed, thereby isolating the interior 27 of the dry tubing from the atmosphere as well as from the interior 24 of the borehole. At this time, there is atmospheric pressure within the isolated tubing interior with the bottom hole pressure exerted by the mud forcing the plug into greater sealed relationship respective to the end of the tubing.

The well is completed by dropping a go-devil through a lubricator (not shown) attached to the wellhead in a known manner. The go-devil falls down hole and impacts against the upper face 58 of the valve element, thereby moving the valve element to the open position in the illustrated manner of FIG. 4. This action moves the upper marginal end of the valve element which heretofore extended into the interior of the tubing into the configuration of FIG. 4, thereby opening the passageway at 46 and permitting fluid flow to occur across the plug until the pressure is equalized thereacross, with the flow occurring along the annulus 46 formed between the axial bore and the valve element. After the pressure has equalized, the valve element, plug, and go-devil gravitate from the end of the tubing in the illustrated manner of FIG. 2, and can be left downhole in the rathole.

Since the surface valves connected to the upper end of the tubing string are closed, and since the hydrostatic head of the well fluid is now less than the formation pressure, there is a pressure exerted at the wellhead and consequently the tubing string can be opened at the surface of the ground to the atmosphere and the well cleaned up by flowing the initial fluids into the mud pit.

The well can then be tied into the gathering system and placed on production.

I claim:

1. Well completion apparatus comprising a tubing string, a packer, a plug; said packer being located above said plug and adapted to pack off the borehole annulus at a location above a production zone;

the lower marginal end of said tubing string removably receiving said plug therewithin, said plug having an outside circumferentially extending surface area made complementary respective to the lower marginal inside peripheral surface of the tubing string; seal means between said plug and said lower marginal end of said tubing string;

an axial bore formed through said plug, an elongated valve element removably received in sealed relationship within said axial bore with a marginal end of said valve element extending above said plug and within said tubing string;

so that when said valve element is placed within said plug and said plug is placed within the marginal end of the tubing string, the string can be run dry into a borehole and a weight can thereafter be dropped down the tubing string to thereby open the valve element and equalize the pressure between the interior of the tubing and the borehole, and thereafter cause the plug to drop from the end of the tubing string so that flow can occur from the borehole and up the tubing string.

2. The apparatus of claim 1 wherein the outer peripheral surface of said plug is tapered and said inner peripheral surface of said tubing string is tapered complementary respective to said plug so that the plug is wedgedly received within said tubing string.

3. The apparatus of claim 2 wherein said seal is an O-ring formed between the mating tapered surfaces of said plug and tubing end.

4. The apparatus of claim 3 wherein said valve element is an elongated member, said end portion which extends into said tubing being reduced in diameter, seal means on the other end portion which sealingly engages the axial bore;

so that when said valve means is forced to move respective to the plug, an annular passageway is formed between the valve element and the plug.

5. In a wellbore having a tubing string extending downhole such that the lower end of the tubing string is located in proximity of a production zone, and a packer interposed between the tubing string and the borehole wall for packing-off the borehole annulus at a location above the production zone, the combination with said tubing string of a plug which isolates the interior of the tubing string from the packed-off interior of the borehole;

means on the lower marginal end of said tubing string for removably receiving said plug therewithin, said plug having an outside circumferentially extending surface area made complementary respective to the lower marginal inside peripheral surface of the tubing string; seal means between said plug and said lower marginal end of said tubing string;

an axial bore formed through said plug, an elongated valve element removably received in sealed relationship within said axial bore with a marginal end of said valve element extending above said plug and within said tubing string;

so that when said valve element is placed within said plug and said plug is placed within the marginal end of the tubing string, the string can be run dry into a borehole and a weight can thereafter be dropped down the tubing string to thereby open the valve element and equalize the pressure between the interior of the tubing string and the borehole, and thereafter cause the plug to drop from the end of the tubing string, so that flow can occur from the borehole and up the tubing string.

6. The combination of claim 5 wherein the outer peripheral surface of said plug is tapered and said inner peripheral surface of said lower marginal end of said tubing string is tapered complementary respective to said plug so that the plug is wedgedly received within said tubing string.

7. The combination of claim 5 wherein the outer peripheral surface of said plug is tapered and said inner peripheral surface of said lower marginal end of the tubing string is tapered complementary respective to said plug so that the plug is wedgedly received within said tubing string;

said seal is an O-ring formed between the mating tapered surfaces of said plug and tubing string marginal end;

said valve element is an elongated member, said end portion which extends into said axial bore being reduced in diameter, seal means on said end portion which sealingly engages the axial bore;

so that when said valve means is forced to move respective to the plug, an annular passageway is formed between the valve element and the axial bore of the plug.

8. The combination of claim 5 wherein said valve element is an elongated member, said end portion which extends into said axial bore being reduced in diameter, seal means on said end portion which extends into said axial bore for sealingly engaging the axial bore;

so that when said valve means is forced to move axially respective to the plug, an annular passageway is formed between the valve element and the plug.

* * * * *